US005771207A

United States Patent [19]

Muroi et al.

[11] Patent Number: 5,771,207

[45] Date of Patent: Jun. 23, 1998

[54] TIME SWITCH

[75] Inventors: Hiroaki Muroi, Osaka; Masanori Matsuda, Moriguchi; Hisao Takahashi; Kazuo Yanagida, both of Agatsuma-gun, all of Japan

[73] Assignees: Matsushita Electric Works, Ltd.; Asahi National Lighting Co., Ltd., both of Osaka, Japan

[21] Appl. No.: 853,439

[22] Filed: May 9, 1997

[30] Foreign Application Priority Data

May 10, 1996 [JP] Japan ..... 8-116785
Mar. 24, 1997 [JP] Japan ..... 9-090066

[51] Int. Cl.[6] ..... G04B 47/00; H01H 1/64; H01H 7/00; H01H 3/34

[52] U.S. Cl. ..... 368/10; 368/88; 200/293; 307/141.4

[58] Field of Search ..... 368/9, 10, 88, 368/276, 278; 200/293, 296, 298; 307/141.4, 141

[56] References Cited

U.S. PATENT DOCUMENTS 4,360,739 11/1982 Goldstein ..... 307/140
4,362,970 12/1982 Grady ..... 315/159
4,588,901 5/1986 Mac Clay et al. ..... 307/141
5,397,930 3/1995 Nilssen ..... 307/150

*Primary Examiner*—Vit W. Miska
*Attorney, Agent, or Firm*—Armstrong, Westerman, Hattori, McLeland & Naughton

[57] ABSTRACT

A time switch for starting and stopping an electric appliance at set times comprises an electric timer, a display housing a display for the set times, and a switch housing having a concave. The switch housing has input terminals, output terminals, and a switch unit for connecting and disconnecting the electric appliance to and from an power source in accordance with an output from the timer. The time switch includes a coupling member for connection of the display housing to the switch housing. The coupling member comprises a cylinder through which lead wires extends between the timer and the switch unit. The coupling member is movably supported to the switch housing along a center axis of the cylinder so that the display housing can move between a normal position where the display housing fits within the concave and an extended position where the display housing projects out of the concave. The coupling member is rotatably supported to the switch housing such that the display housing can rotate about the center axis of the cylinder at the extended position. This time switch presents an advantage that it is easy to check the set times on the display irrespective of installation angle of the time switch to a switchboard or the like.

10 Claims, 18 Drawing Sheets

TIME SWITCH

BACKGROUND OF THE INVENTION

1. Field of the Invention

The present invention relates to a time switch for starting and stopping an electric appliance at set times.

2. Disclosure of the Prior Art

In the past, an electronic-type time switch of checking time according to a clock signal with a constant period caused by a quartz oscillator is known. The time switch generally comprises a timer housing incorporating an electric timer with the quarts oscillator, and a switch housing having input terminals for electrical connection with an electric power source, output terminals for electrical connection with an electric appliance, and a switch unit for connecting and disconnecting the electric appliance to and from the electric power source in accordance with an output from the electric timer. The display housing is formed on its surface with input buttons for entering set times into the electric timer and a liquid crystal display for the set times. The time switch of this type may be installed on a switchboard to control turning-on and -off operations of lights. However, when an installation angle of the time switch to the switchboard is not proper, it will be hard for a user to enter set times into the electric timer and check the display.

For improving this problem, Japanese Patent Early publication [KOKAI] No. 58-92887 discloses a time switch 1S comprising a main body 10S and a time input operation part 20S detachably supported to the main body, as shown in FIG. 25. The operation part 20S can move between a normal position where the operation part fits in a recessed part 11S and a projected position where the operation part is spaced away from the main body 10S. At the projected position, the operation part 20S is coupled with the main body 10S only by lead wires 30S extending between an electric timer in the operation part and a switch unit in the main body. In this time switch, since the operation part 20S can freely rotate at the projected position, it will be easy to enter set times into the electric timer and check a display 21S of the operation part irrespective of installation angle of the time switch 1S to a switchboard. However, when the operation part 20S accidentally drops from a user's hand at the projected position, there is a possibility that the lead wires 30S are down because of a weight of the operation part.

On the other hand, Japanese Patent Early Publication [KOKAI] No. 5-67420 discloses a time switch 1V comprising a time switch main body 10V incorporating a switch unit, and a display unit 20V rotatably supported to the main body, as shown in FIG. 26. The display unit 20V is mounted on the main body 10V between an upper wall 11V having a concave 12V and a detachable terminal cover 13V to small-size the time switch 1V. The concave 12V is formed in the upper wall 11V such that the display unit 20V can rotate about a rotating axis passing a center of a top surface of the display unit without being interfered with the upper wall. However, the terminal cover 13V must be detached from the main body 10V in every work. In addition, the time switch 1V is formed such that a width of the display unit 20V is substantially equal to that of the main body 10V. However, corner portions of the display unit 20V will project from the main body 10V during the rotation of the display unit. Therefore, when the plural number of time switches 1V are densely installed on a switchboard, there is a problem that a rotation of each of the display units 20V is interfered with an adjacent display unit. For avoiding this problem, each of the time switches 1V must be installed at an interval with the adjacent time switch, although, this prevents to efficiently install the time switches 1V on the switchboard.

Thus, there is room for further improvement in the time switches of the prior art.

SUMMARY OF THE INVENTION

Therefore, a primary object of the present invention is to provide a time switch capable of eliminating the above problems. That is, the time switch comprises an electric timer, a display housing having an input unit for entering set times into the electric timer and a display for the set times, and a switch housing formed in its top surface with a concave within which the display housing fits such that the input unit and the display are available. The switch housing has an input terminal for electrical connection with an electric power source, an output terminal for electrical connection with an electric appliance, and a switch unit for connecting and disconnecting the electric appliance to and from the electric power source in accordance with an output from the electric timer. In the present invention, the time switch includes a coupling member for connection of the display housing to the switch housing. The coupling member comprises a cylinder through which lead wires extend for electrical connection between the electric timer and the switch unit. The coupling member is movably supported to the switch housing along a center axis of the cylinder so that the display housing can move between a normal position where the display housing fits within the concave and an extended position where the display housing projects out of the concave. The coupling member is also rotatably supported to the switch housing such that the display housing can rotate about the center axis of the cylinder at the extended position without being interfered with the switch housing. Since the lead wires is protected from the outside by the cylinder, it is possible to reduce an accidental breaking of the lead wires. In addition, when the plural number of time switches are installed close to each other on a switchboard or the like, it is possible to rotate each of the display housings at the extended position without being interfered with an adjacent time switch. As a result, it is easy to enter set times into the electric timer and check the display even when the time switches are densely installed on the switchboard.

In a preferred embodiment of the present invention, the coupling member is composed of first and second coupling members. The first coupling member has a first cylinder and is supported to the switch housing to be slidable along a center axis of the first cylinder. The second coupling member has a tube-like shape and depends from the display housing. The second coupling member is slidably supported to the first coupling member along the center axis of the first cylinder. In this case, it is possible to further small-size the time switch and at same time project the display housing from the switch housing at an increased projection height. Therefore, even when the time switch is installed adjacent to a breaker having a relatively large handle, the display housing can rotate at the extended position without being interfered with the adjacent breaker handle.

In a further preferred embodiment of the present invention, the switch housing has a first cylindrical guide wall projecting into the concave. The display housing has a second cylindrical guide wall of a larger diameter than the second coupling member depending from the display housing such that the second cylindrical guide wall and the second coupling member are disposed in a concentric manner. The first coupling member includes a first circular groove into which the first cylindrical guide wall is slidably inserted for guiding the first coupling member to move along the center axis of the first cylinder, and a second circular groove into which the second cylindrical guide wall is slidably inserted for guiding the second coupling member to move along the center axis of the first cylinder. This can provide a smooth movement of the display housing between the normal position and the extended position.

It is also preferred that the time switch comprises a stopper for restricting the rotation of the display housing against the switch housing within one turn to reduce a torsion of the lead wires.

These and still other objects and advantages will become apparent from the following description of the preferred embodiments of the invention when taken in conjunction with the attached drawings.

BRIEF DESCRIPTION OF THE DRAWINGS

FIGS. 25A to 23E are schematic diagrams explaining an action of a hook release lever of the second embodiment;

DETAIL DESCRIPTION OF THE PREFERRED EMBODIMENTS

<First Embodiment>

Figure 1:
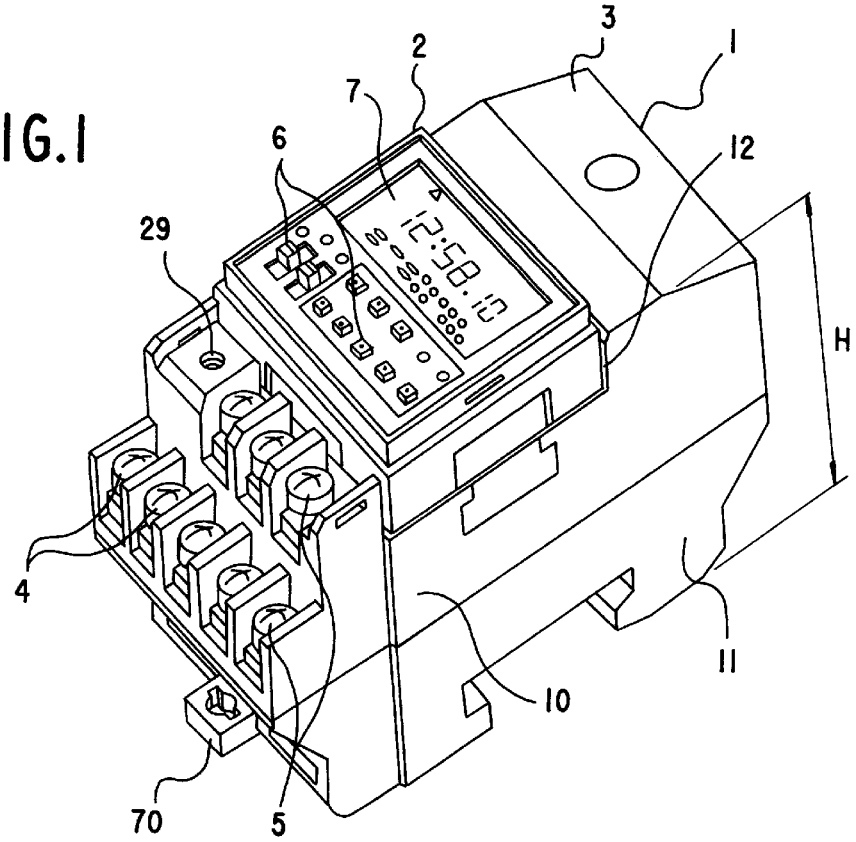
FIG. 1 is a perspective view of a time switch a first embodiment of the present invention.
Figure 2:
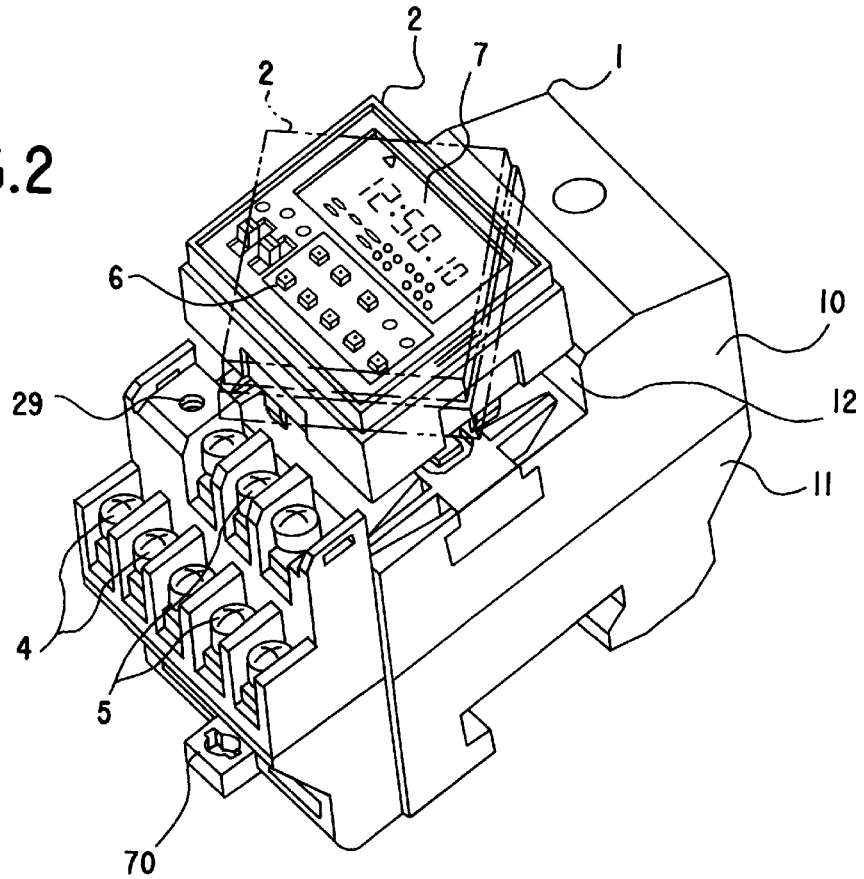
FIG. 2 is a perspective view of the time switch where a timer housing is held at an extended position.
Figure 3:
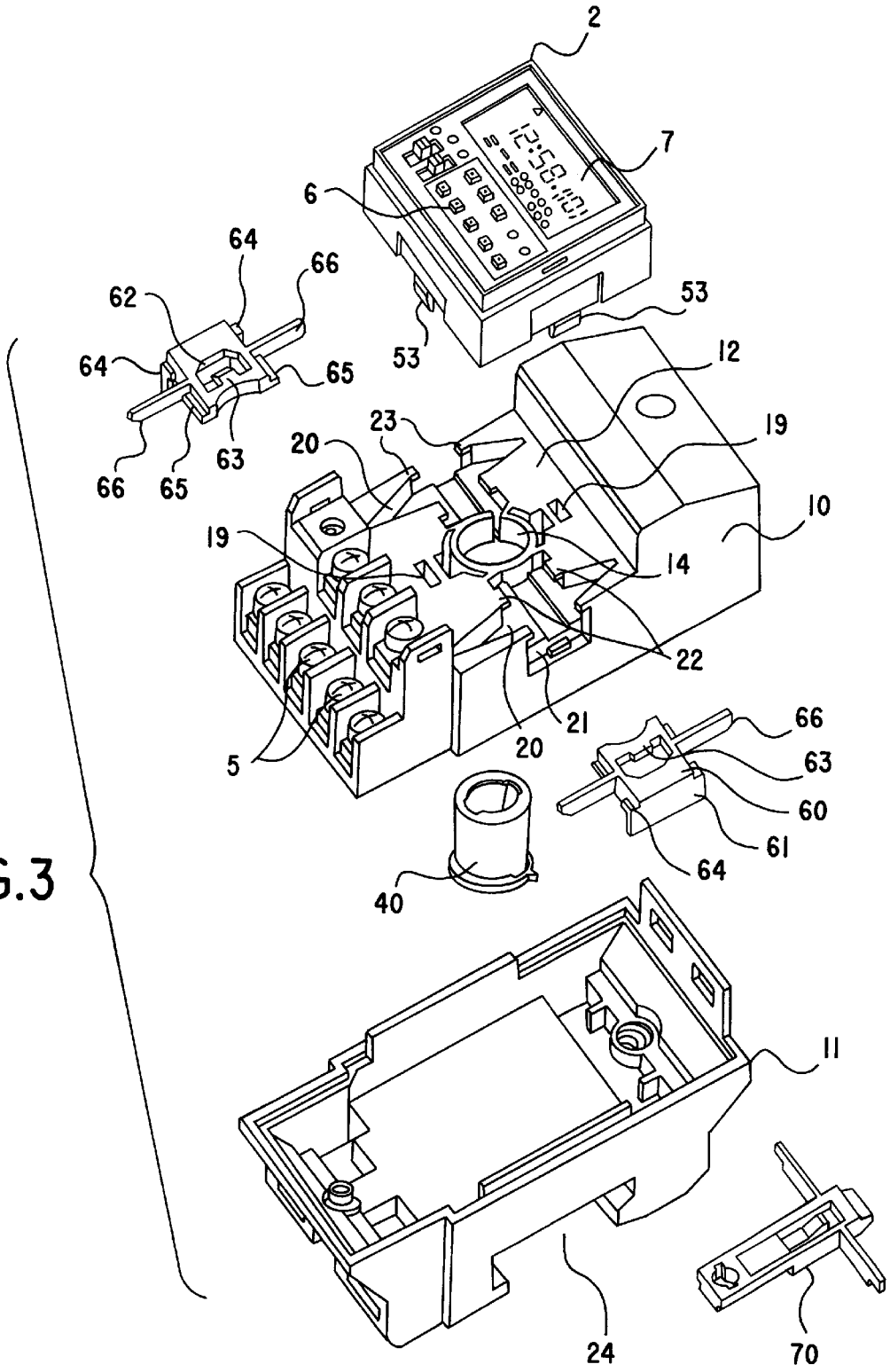
FIG. 3 is an exploded perspective view of the time switch.
Figure 4:
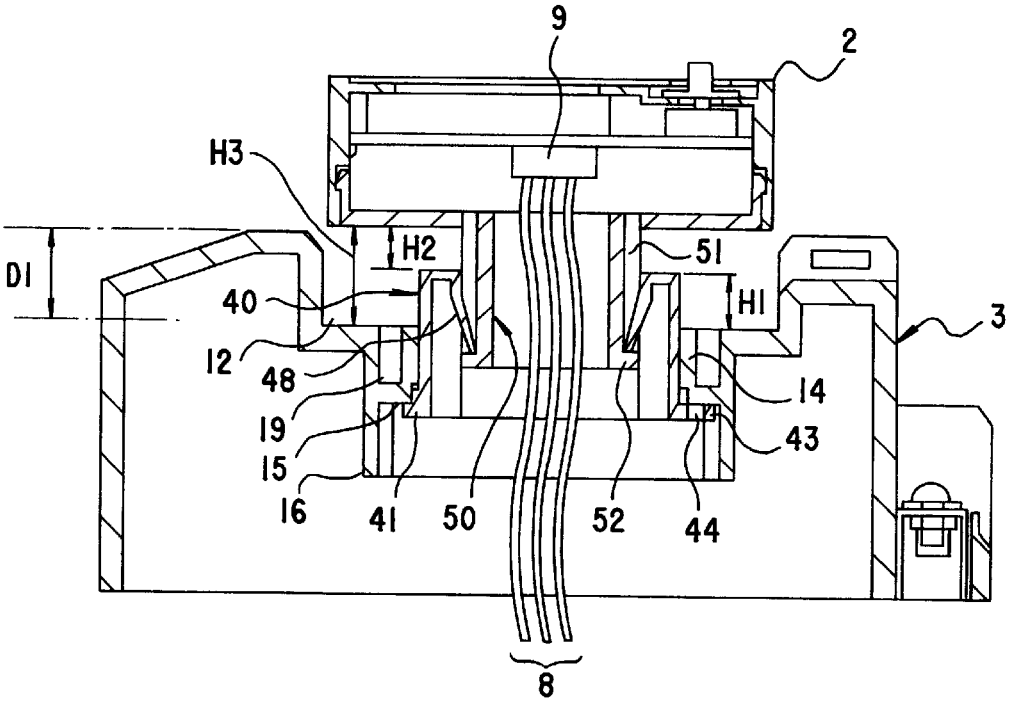
FIG. 4 is a partially cross-sectional view of the time switch.
Figure 5:
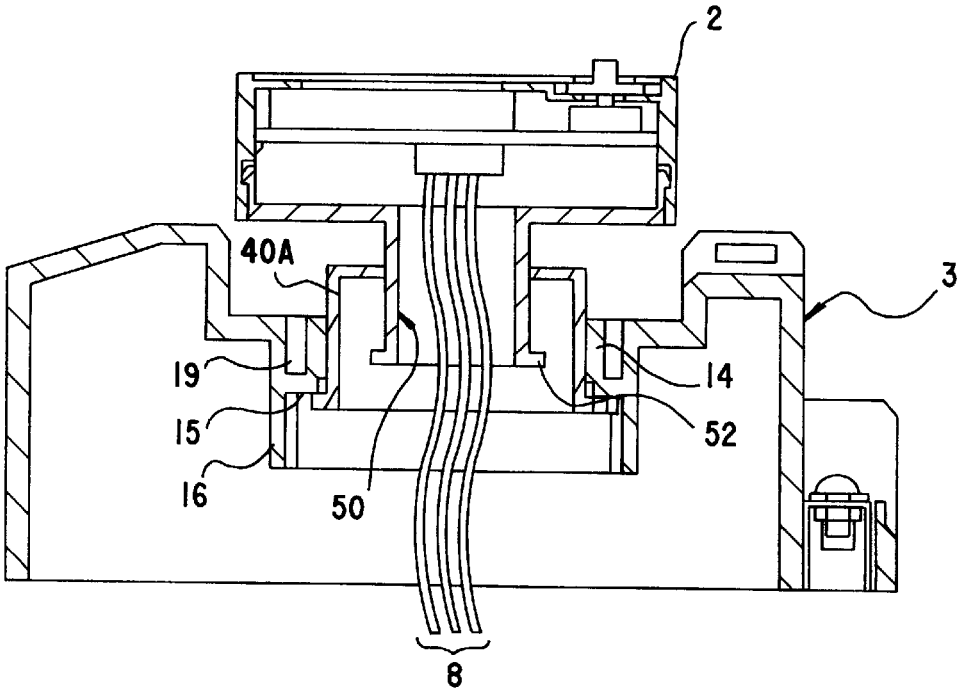
FIG. 5 is a partially cross-sectional view of a time switch of a first modification of the first embodiment.
Figure 6:
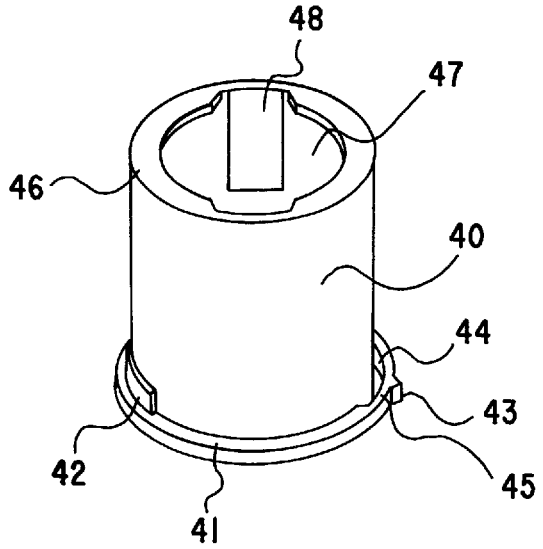
FIG. 6 is a perspective view of a cylinder member of the time switch.
Figure 7:
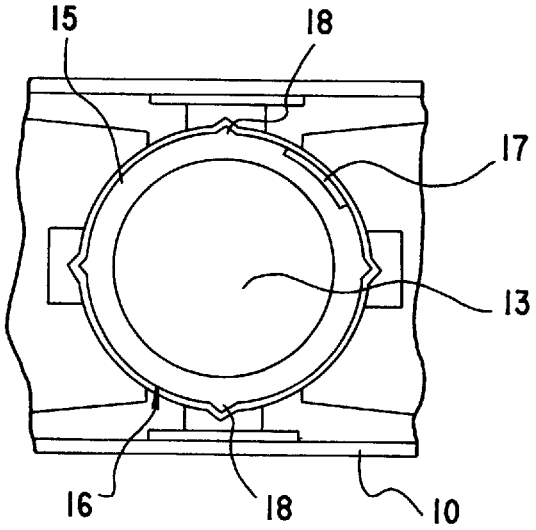
FIG. 7 is a partially bottom view of a top housing of the switch housing.
Figure 8:
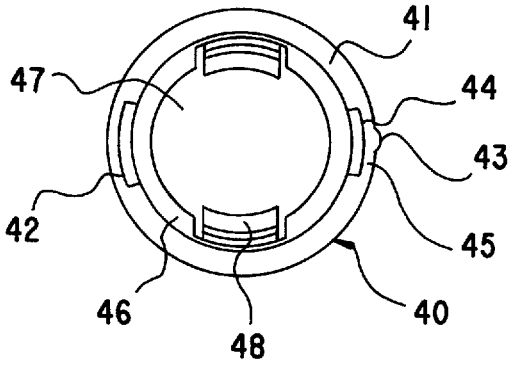
FIG. 8 is a top view of the cylinder member.

A time switch 1 for starting and stopping an electric appliance such as lights at set times comprises a timer housing 2 incorporating therein an electric timer, and a switch housing 3 having input terminals 4 for electrical connection with an electric power source, and output terminals 5 for electrical connection with the electric appliance. The timer housing 2 has a substantially square top surface on which input buttons 6 for entering set times into the electric timer and a display 7 for the set times are disposed. A width of the switch housing 3 is substantially equal to one side of the timer housing 2. If necessary, the input and output terminals (4, 5) can be protected from the outside by the use of a terminal cover (not shown). Numeral 29 designates a screw hole for fixing the terminal cover to the switch housing 3. The switch housing 3 is made of an electrically insulating material such as a synthetic resin, and incorporates therein a switch unit (not shown) for connecting and disconnecting the electric appliance to and from the electric power source in accordance with an output from the electric timer. In this embodiment, the electric timer is incorporated in the timer housing 2, although, it is possible to incorporate the electric timer in the switch housing 3. The switch housing 3 is formed in its top surface with a concave 12. The timer housing 2 can move between a normal position where the timer housing fits within the concave 12 such that the input buttons 6 and the display 7 are available, as shown in FIG. 1, and an extended position at which the timer housing projects out of the concave, as shown in FIG. 2. In addition, the timer housing 2 can rotate about a rotating axis at the extended position without being interfered the switch housing 3. In the present time switch 1, even if the terminal cover is attached to the time switch, it is possible to rotate the timer housing 2 at the extended position without removing the terminal cover from the switch housing 3. In FIG. 1, a height H of the switch housing is 60 mm. As shown in FIG. 3, the switch housing 3 can be divided to a top housing 10 and a bottom housing 11. The top housing 10 can be fixed to the bottom housing 11 by the use of screws. The top housing 10 has a circular hole 13 in the concave 12. As shown in FIG. 4, the top housing 10 comprises an inner ring-like wall 14 extending around the circular hole 13, a joint wall 15 extending horizontally and outwardly from the bottom end of the inner ring-like wall, and an outer ring-like wall 16 extending downwardly from the joint wall. Numeral 40 designates a cylinder member as a coupling member for coupling between the timer housing 2 and switch housing 3. The cylinder member 40 is inserted into the circular hole 13 so as to slidably contact with the inner ring-like wall 14 in a direction of the center axis of the cylinder member and a rotating direction about the center axis. The cylinder member 40 is formed at its bottom end with a flange 41. A maximum projection height H1 of the cylinder member 40 in the concave 12 is obtained by a contact of the flange 41 with the joint wall 15. The cylinder member 40 has a rotation restricting projection 42 formed on the flange along an outer surface of the cylinder member, as shown in FIG. 6. Since the projection 42 collides with a stopper projection 17 formed on the joint wall 15, as shown in FIG. 7, during a.

rotation of the cylinder member 40 in the inner ring-like wall 14, it is possible to restrict the rotation of the cylinder member within one turn. In FIG. 8, numeral 43 designates a click-stop projection formed on the flange 41 of the cylinder member 40, which can selectively engage to one of four V-notches 18 formed per 90 degrees of the outer ring-like wall 16 to establish a click-stop of the cylinder member. Numeral 44 designate an arcuate hole formed in the flange 41 adjacent to the click-stop projection 43. By the formation of the arcuate hole 44, a frame portion 45 having the click-stop projection 43 can readily cause an elastic deformation to make the engagement of the click-stop projection with the V-notch 18. The cylinder member 40 is formed with a top wall 46 having a circular opening 47, into which a cylinder 50 depending from a bottom surface of the timer housing 2 is inserted. The cylinder member 40 has a pair of rectangular plates 48 obliquely downwardly extending from the top wall 46 inside the cylinder member. Top ends of the rectangular plates 48 fit within a pair of guide ribs 51 formed in an outer surface of the cylinder 50 in an axial direction of the cylinder to prevent a rotation of the timer housing 2 against the cylinder member 40 about a center axis of the cylinder. Therefore, when the timer housing 2 is rotated at the extended position, both of the cylinder 50 and the cylinder member 40 simultaneously rotate about the center axis of the cylinder against the switch housing 3. The cylinder 50 is formed at its bottom end with a flange 52. A maximum projection height H2 of the cylinder 50 from the top wall 46 of the cylinder member 40 is obtained by a contact of the flange 52 with the rectangular plates 48. In FIG. 4, a depth D1 of the concave 12 from the top surface of the switch housing 3 is 10 mm. A height H3 (=H1+H2) from the bottom of the concave 12 to a bottom surface of the timer housing 2 held at the extended position is 10.5 mm. Therefore, the timer housing 2 can project out of the concave 12 at the extended position. As a first modification of this embodiment, when it is desired to increase the maximum projection height H2 of the cylinder 50, it is possible to use a cylinder member 40A without the rectangular plates 48, as shown in FIG. 5. Lead wires 8 for electrical connection between the electric timer and the switch unit pass through the cylinder 50 and the cylinder member 40, as shown in FIG. 4. Therefore, when the timer housing 2 is held at the extended position, it is possible to prevent an exposure of the lead wires 8, and an invasion of dust inside the switch housing 3. In addition, since the rotation of the timer housing 2 against the switch housing 3 is restricted within one turn, it is possible to minimize the occurrence of a torsion of the lead wires 8 at the inside of the cylinder member 40. The lead wires 8 are detachably connected to the electric timer through a connector 9. When the connector 9 is detached from the electric timer, the timer housing 2 can be separated from the switch housing 3.

Figure 11A:
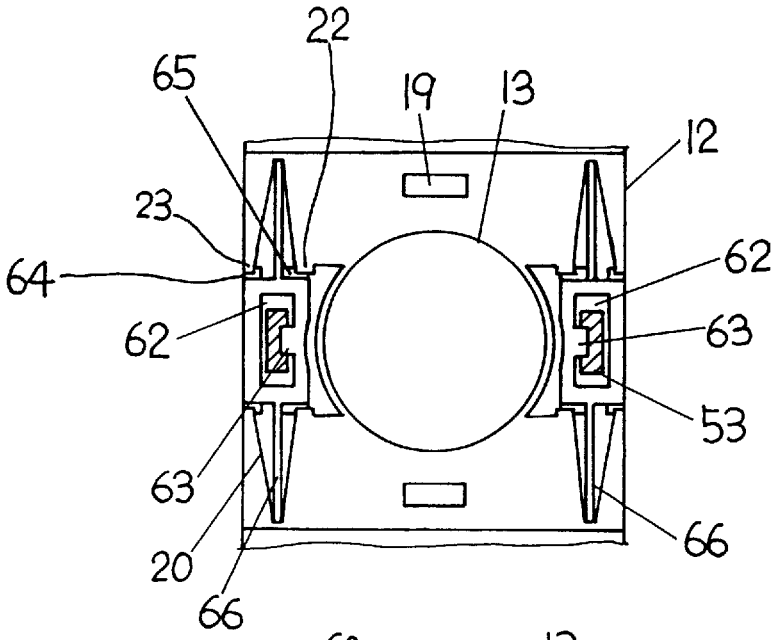
FIGS. 11A and 11B are top views of a concave of the switch housing.

In this embodiment, the timer housing 2 can be locked in the concave 12 of the switch housing 3 at the normal position in accordance with the following manner. In FIG. 3, numeral 53 designates nail members depending from four sides of the timer housing 2. Numeral 60 designates a pair of lock members for making engagements with one pair of the nail members 53 depending from the opposite sides of the timer housing 2. Numeral 19 designates a pair of rectangular holes for accommodating therein the other pair of the nail members 53. Therefore, it is possible to lock the timer housing 2 in the concave 12 per 90° turn about the center axis of the inner ring-like wall 14. The lock member 60 is formed with a release button 61, top opening 62 into which the nail member 53 can be inserted, hook 63 projecting into the top opening 62, first and second projections (64, 65), and a pair of spring arms 66. On the other hand, the top housing 10 has a pair of substantial rhombus cavities 20 formed in the concave 12, rectangular holes 21 coupled with the rhombus cavities, and first and second retainers (22, 23). Each of the lock members 60 is installed in the rhombus cavity 20 such that the first and second projections (64, 65) are caught by the first and second retainers (22, 23), respectively, as shown in FIG. 11A.

Figure 9:
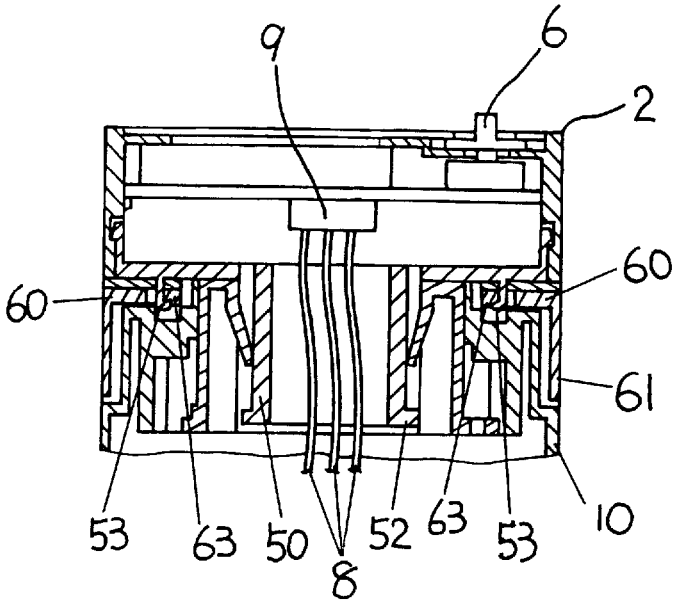
FIG. 9 is a partially cross-sectional view of the time switch of FIG. 1.
Figure 11B:
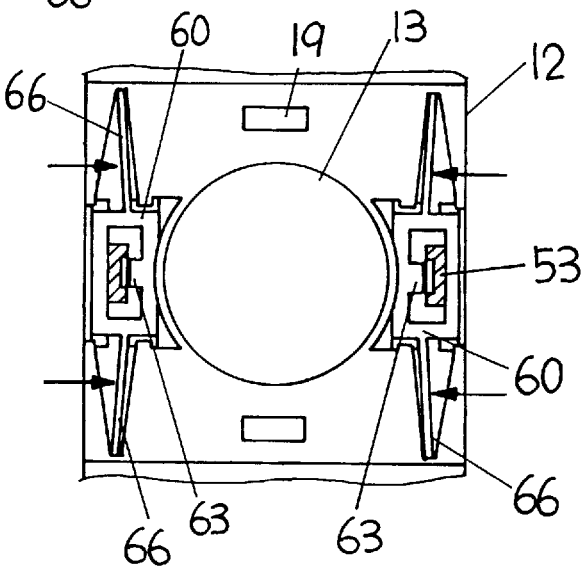
Figure 12A:
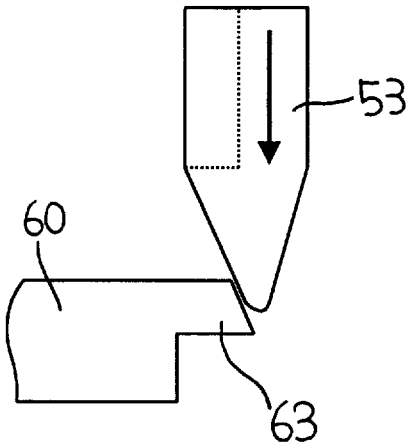
FIGS. 12A to 12E are schematic diagrams explaining an action of a lock member of the first embodiment.

When moving the timer housing 2 from the extended position to the normal position, a top end of each of the nail members 53 firstly collides with the hook 63 of the lock member 60, as show in FIG. 12A. As the nail member 53 is further inserted into the top opening 62 of the lock member 60, the hook 63 slides along a slope of the nail member, as shown in FIG. 12B, so that the lock member horizontally moves toward the circular hole 13 while the spring arms 66 being bent, as pointed by the arrows of FIG. 11B. When the hook 63 reaches a hook receiving groove 54 of the nail member 53, it is inserted into the hook receiving groove by a restoration force of the spring arms 66 to finish the locking operation of the timer housing 2 in the concave 12, as shown in FIGS. 9, 11A and 12C.

Figure 10:
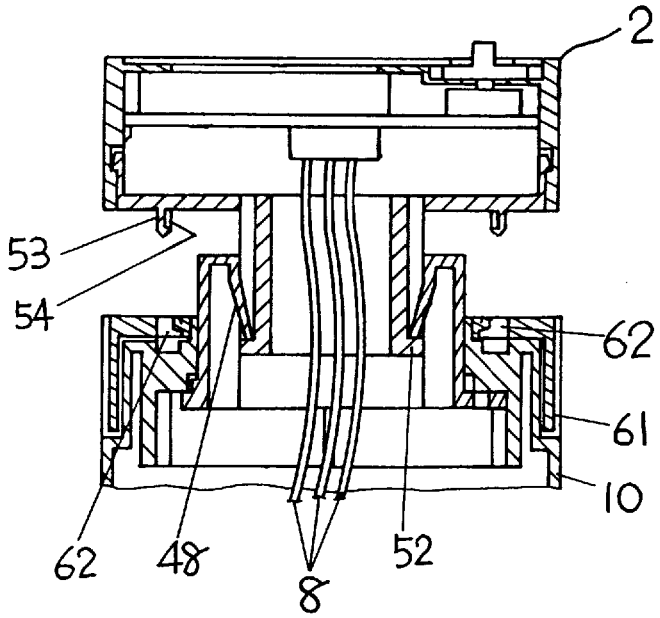
FIG. 10 is a partially cross-sectional view of the time switch of FIG. 2.
Figure 12D:
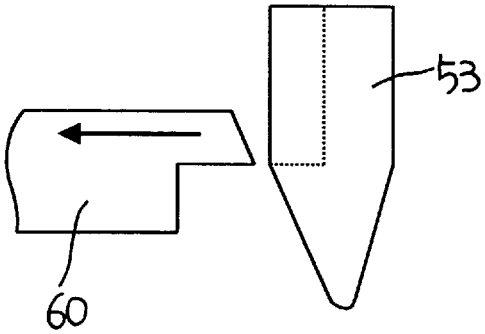
Figure 12B:
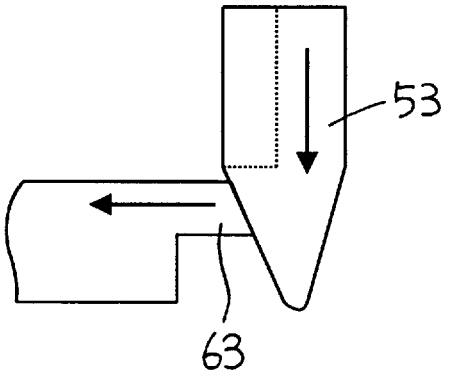
Figure 12E:
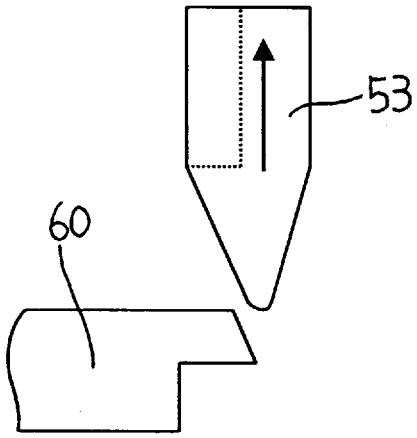
Figure 12C:
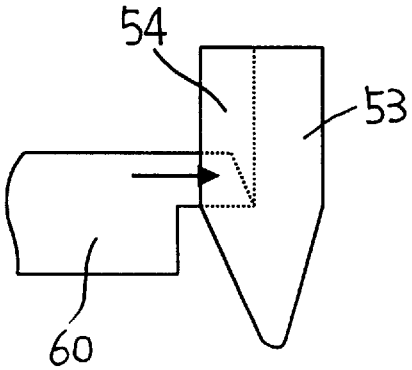

To move the timer housing 2 from the normal position to the extended position, both of the release buttons 61 must be pushed to remove the hook 63 from the hook receiving groove 54, as shown in FIG. 12D. When moving the timer housing 2 upward while pushing the release buttons 61, the nail members 53 are removed out of the top opening 62 of the lock member 60, as shown in FIG. 12E, so that the extended position of the timer housing is obtained, as shown in FIG. 10. In this embodiment, since the spring arms 66 are integrally molded with the lock member 60 by the use of an elastic resin material, it is not necessary to separately prepare spring members. As a result, it is possible to reduce the number of parts for the time switch, and speed up a fabrication process of the time switch. In FIG. 3, numeral 24 designates a guide groove for receiving a rail formed on a switchboard. Numeral 70 designates an attachment of the time switch 1 to the switchboard.

Figure 13:
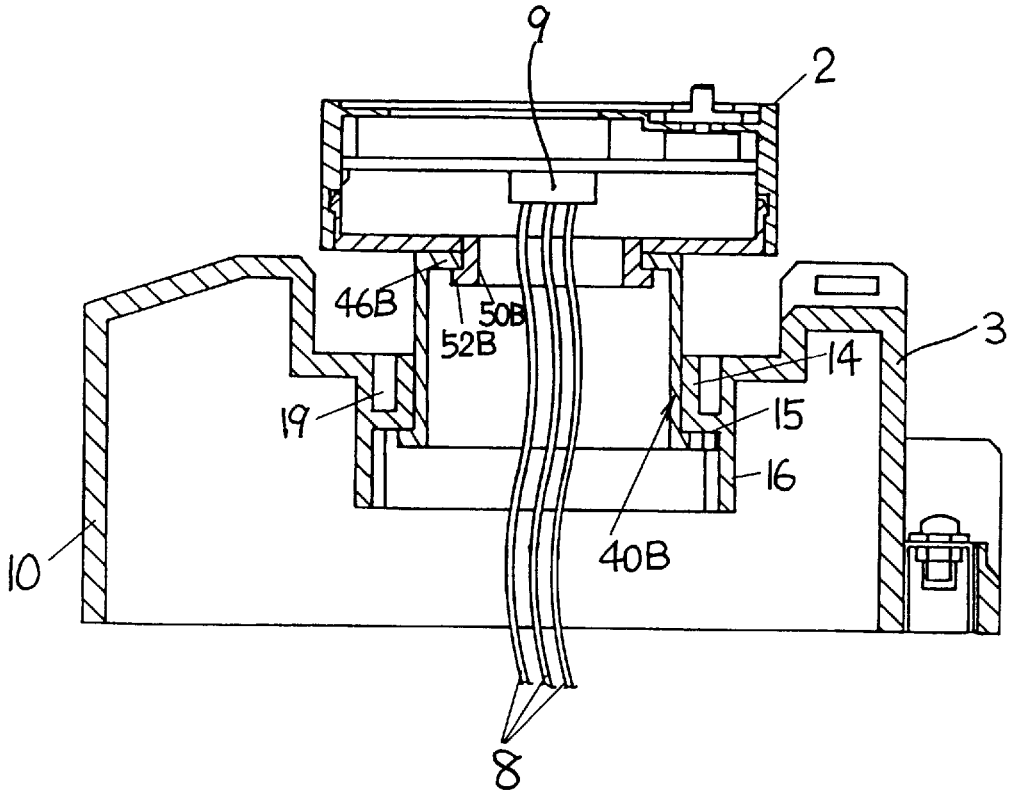
FIG. 13 is a perspective view of a time switch of a second modification of the first embodiment.

As a second modification of the time switch 1, it is possible to use a cylinder 50B having a reduce length in place of the cylinder 50 depending from the timer housing 2. The length of the cylinder 50B is determined such that a top wall 46B of a cylinder member 40B is sandwiched between a flange 52B of the cylinder 50B and the bottom surface of the timer housing 2, as shown in FIG. 13. Therefore, in the time switch of this type, the cylinder 50B can not move in a direction of its center axis against the cylinder member 40B. Except for the above-described difference, this modification is substantially same as the first embodiment.

<Second Embodiment>

Figure 14:
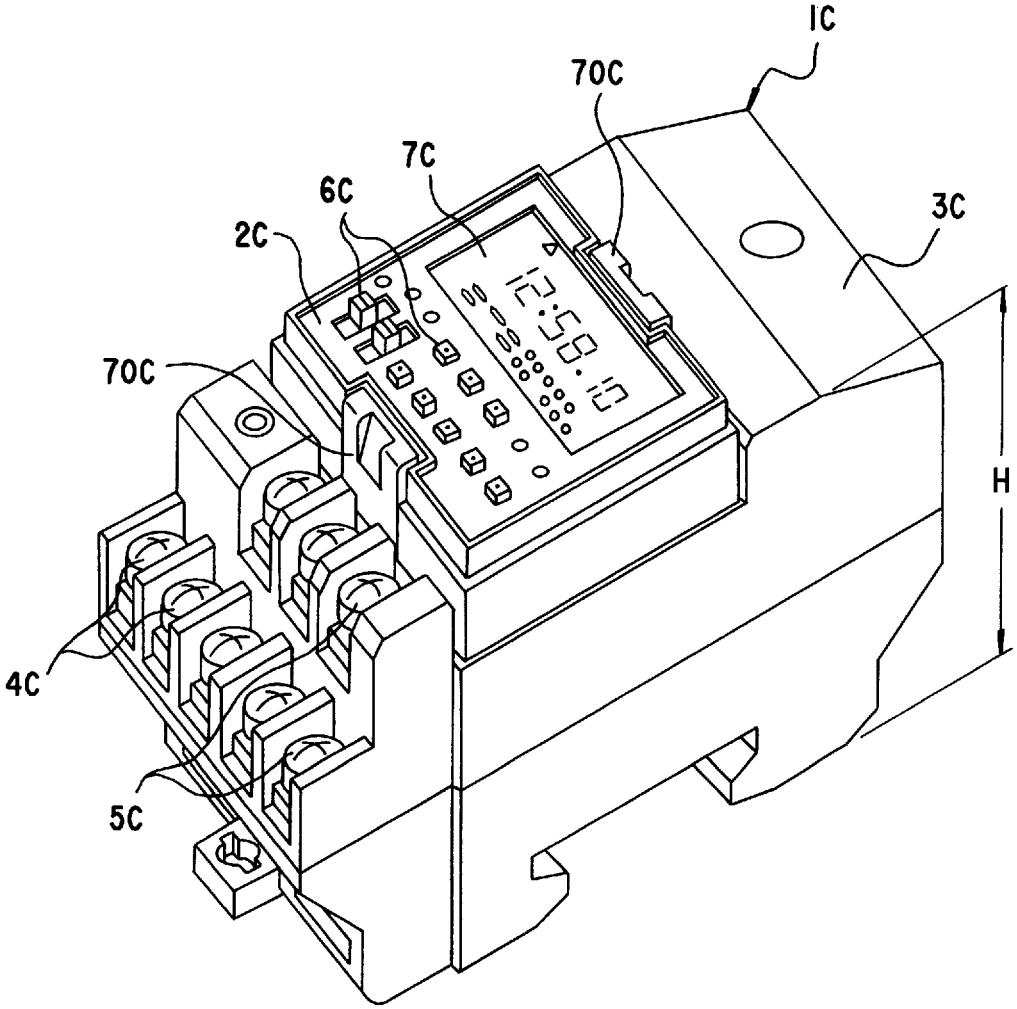
FIG. 14 is a perspective view of a time switch of a second embodiment of the present invention.
Figure 15:
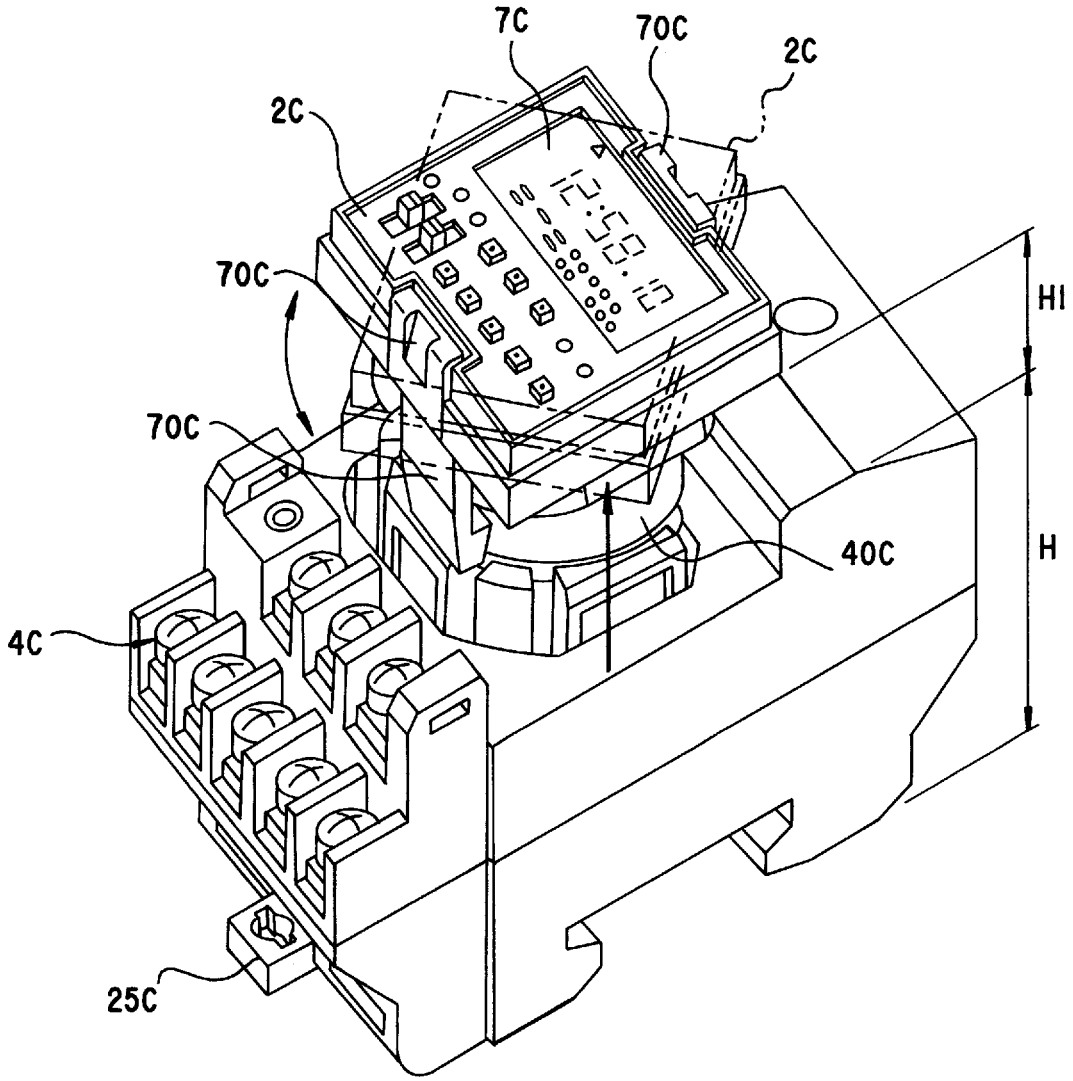
FIG. 15 is a perspective view of the time switch where a timer housing is held at an extended position.

In the second embodiment, a time switch 1C for starting and stopping an electric appliance at set times comprises a timer housing 2C incorporating therein an electric timer, and a switch housing 3C having input terminals 4C for electrical connection with an electric power source, and output terminals 5C for electrical connection with the electric appliance. The timer housing 2C has a substantially square top surface on which input buttons 6C for entering set times into the electric timer and a display 7C for the set times are disposed. A width of the switch housing 3C is substantially equal to one side of the timer housing 2C. The switch housing 3C incorporates therein a switch unit (not shown) for connecting and disconnecting the electric appliance to and from the electric power source in accordance with an output from the electric timer. The switch housing 3C is formed in its top surface with a concave 12C. The timer housing 2C can move between a normal position where the timer housing fits within the concave 12C such that the input buttons 6C and the display 7C are available, as shown in FIG. 14, and an extended position at which the timer housing projects out of the concave, as shown in FIG. 15. In addition, the timer housing 2C can rotate about a rotating axis at the extended position without being interfered the switch housing 3C, as pointed out by dotted lines in FIG. 15. In FIG. 15, a height H of the switch housing 3C is 60 mm. A projection height H1 of the timer housing 2C from a top surface of the switch housing 3C to a bottom surface of the timer housing at the extended position is 21 mm.

Figure 16:
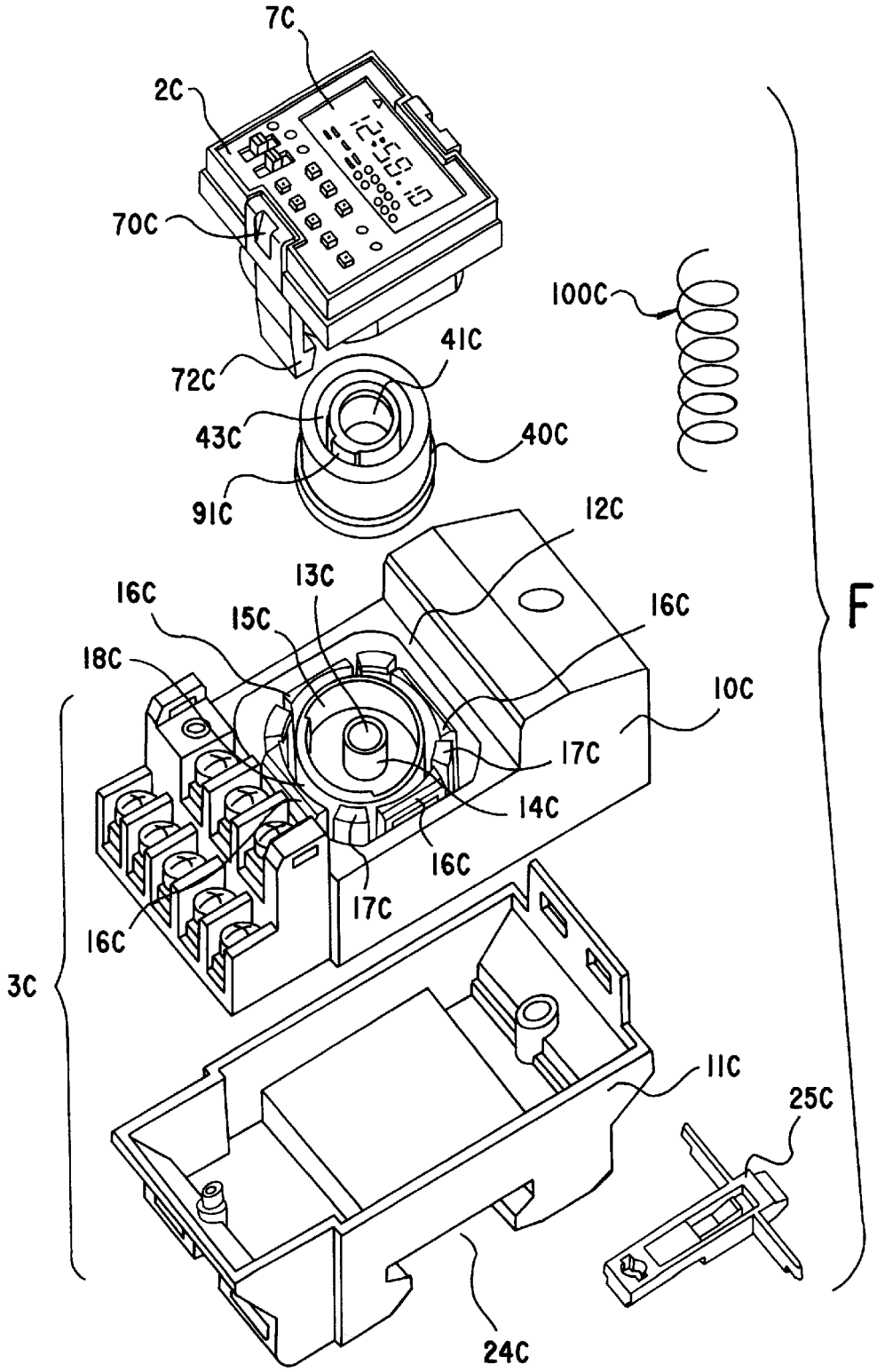
FIG. 16 is an exploded perspective view of the time switch of the second embodiment.
Figure 18:
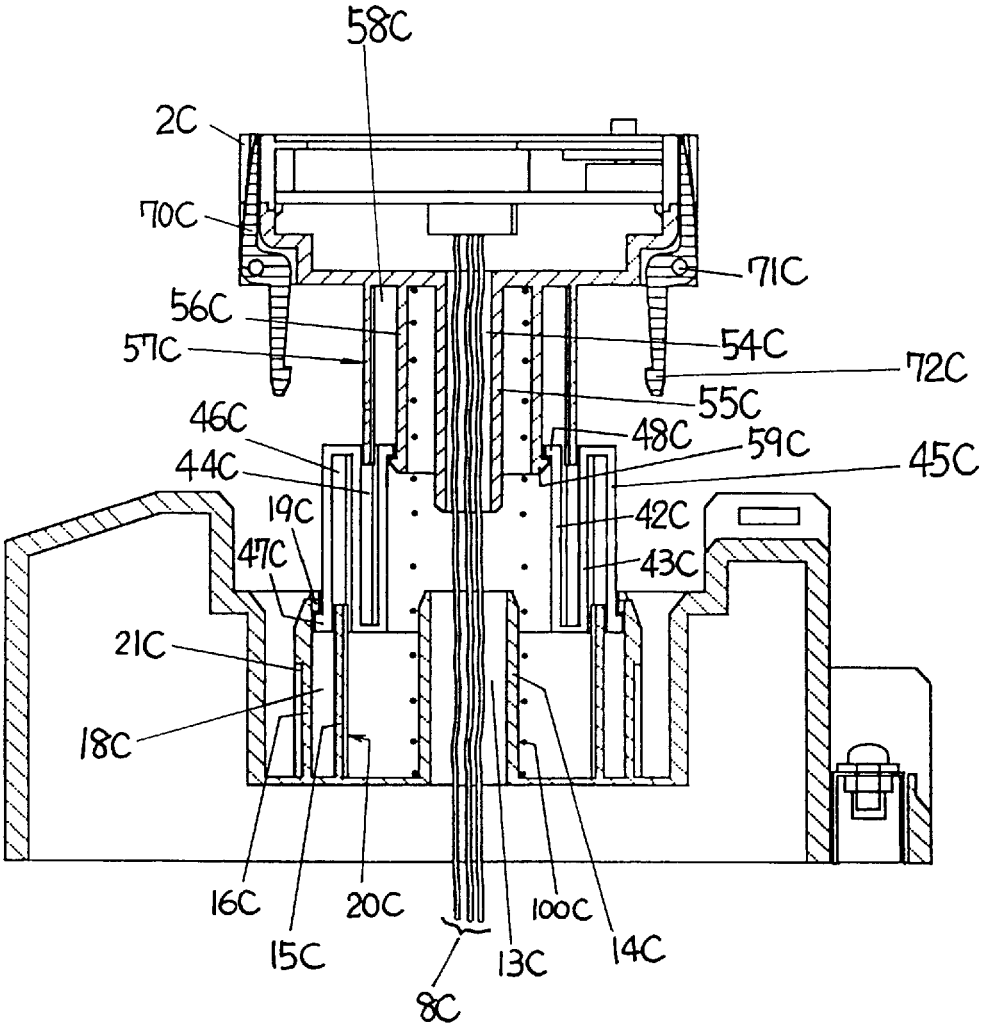
FIG. 18 is cross-sectional view of the time switch of FIG. 15.

As shown in FIG. 16, the switch housing 3C can be divided to a top housing 10C and a bottom housing 11C. The top housing 10C is fixed to the bottom housing 11C by the use of screws. Numeral 24C designates a guide groove for receiving a rail formed on a switchboard. Numeral 25C designates an attachment of the time switch 1C to the switchboard. The top housing 10C has a circular through-hole 13C, an inner ring-like wall 14C surrounding the circular hole 13C, and an outer ring-like wall 15C formed in a concentric relation with the inner ring-like wall. In addition, the top housing 10C is formed in the concave 12C with four lock members 16C disposed per 90° degrees about a center axis of the inner ring-like wall, and four arcuate walls 17C each of which is disposed between adjacent two lock members, so that a first circular guide groove 18C is formed between the outer ring-like wall 15C and inner surfaces of the lock members 16C and the arcuate walls 17C. Numeral 40C designates a coupling member for coupling between the timer housing 2C and the switch housing 3C. As shown in FIG. 18, the coupling member 40C is formed in a cylindrical shape with a circular through hole 41C, an first ring-like wall 42C surrounding the circular hole 41C, a second ring-like wall 43C formed in a concentric relation with the first ring-like wall, a second guide groove 44C formed between the first and second ring-like walls, a third ring-like wall 45C formed in a concentric relation with the first ring-like wall, and a third guide groove 46C formed between the second and third ring-like walls. The coupling member 40C is movably supported to the switch housing 3C such that the outer ring-like wall 15C is slidably inserted into the third guide groove 46C, and the third ring-like wall 45C is slidably inserted into the first guide groove 18C, in order to guide the coupling member to move along the center axis of the inner ring-like wall 14C, and rotate the coupling member about the center axis of the inner ring-like wall. The third ring-like wall 45C of the coupling member 40C is formed at its bottom end with a first flange 47C. A maximum projection height of the coupling member 40C from the concave 12C is obtained by a contact of the first flange 47C with a stopper projection 19C formed at a top end of each of the arcuate walls 17C.

Figure 17:
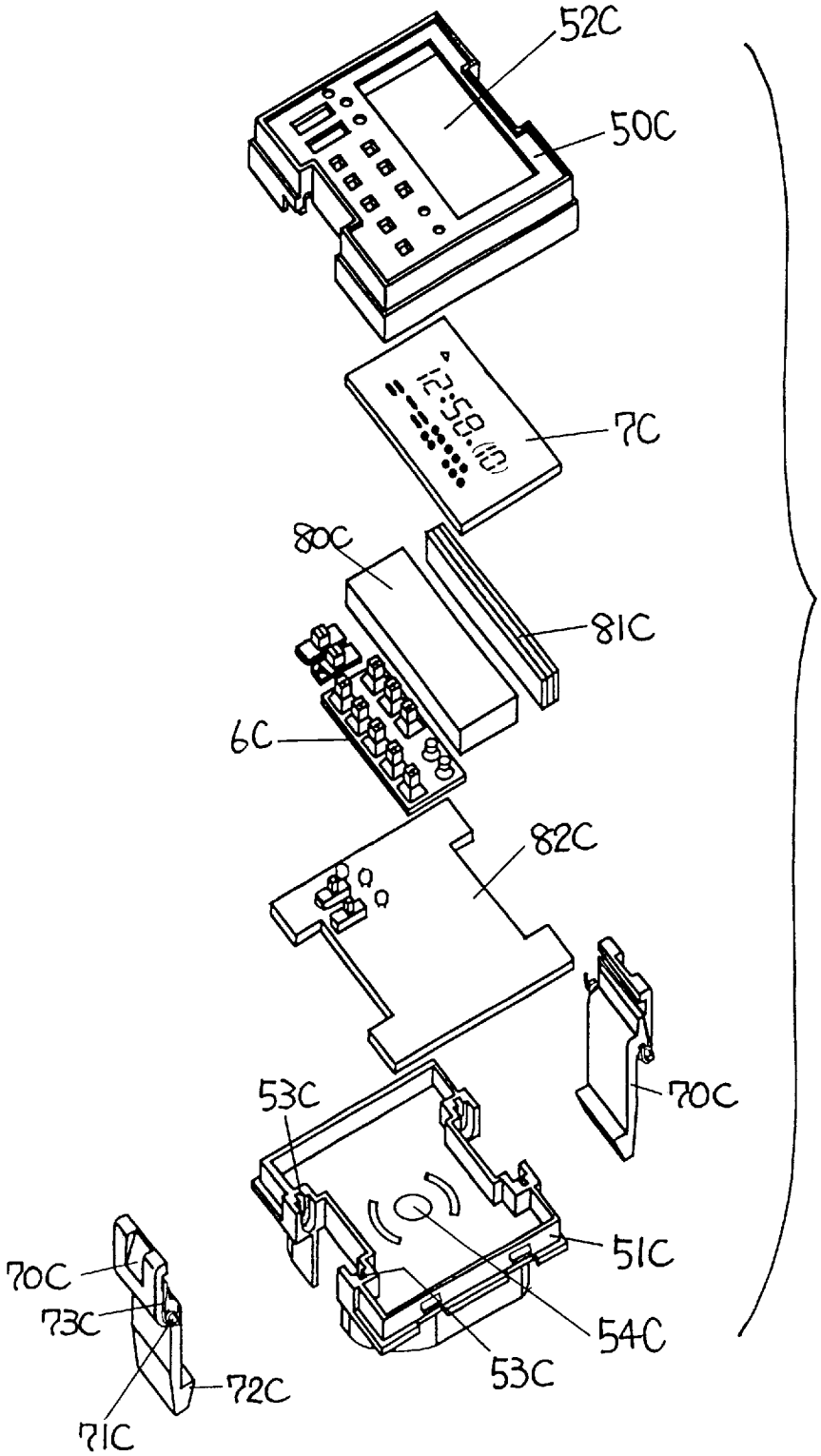
FIG. 17 is an exploded perspective view of the timer housing incorporating an electric timer therein.

As shown in FIG. 17, the timer housing 2C is divided into a top case 50C having a rectangular window 52C for the display 7C, and a bottom case 51C. The timer housing 2C incorporates therein a liquid crystal panel 7C used as the display, a liquid crystal supporting member 80C, conductive rubber 81C, switch members 6C used as the input buttons, and a circuit board 82C mounting thereon a timer circuit (not shown), slidable switches and light emitting diodes (LED), etc. A pair of hook release levers 70C having pivot shafts 71C are attached to opposite sides of the timer housing 2C such that each of the release levers is movably supported about the pivot shaft. Each of the release levers 70C is formed at its bottom end with a hook 72C. In FIG. 17, numeral 53C designate a bearing portion of the bottom case 51C for receiving the pivot shaft 71C of the release lever 70C. Numeral 73C designate a spring member for exerting a spring bias to the release lever attached to the timer housing 2C. As shown in FIG. 18, the bottom case 51C has a circular through-hole 54C, a fourth ring-like wall 55C surrounding the circular hole 54C and depending from a bottom surface of the bottom case, a fifth ring-like wall 56C formed in a concentric relation with the fourth ring-like wall, a sixth ring-like wall 57C formed in a concentric relation with the fourth ring-like wall, and a fourth guide groove 58C defined between the fifth and sixth ring-like walls. The coupling member 40C is coupled with the timer housing 2C such that the sixth ring-like wall 57C is slidably inserted into the second guide groove 44C of the coupling member, and the first ring-like wall 42C of the coupling member is slidably inserted into the fourth guide groove 58C, in order to guide the timer housing to move along the center axis of the inner ring-like wall 14C of the switch housing 3C, and rotate the timer housing about the center axis of the inner ring-like wall. The fourth ring-like wall 55C is inserted into the through-hole 13C of the inner ring-like wall 14C when the timer housing 2C is held at the normal position. The fifth ring-like wall 56C of the timer housing 2C is formed at its bottom end with a pair of second flanges 59C. A maximum projection height of the timer housing 2C from a top surface of the coupling member 40C is obtained by contacts of the second flanges 59C with stopper projections 48C formed at a top end of the first ring-like wall 42C.

Figure 19:
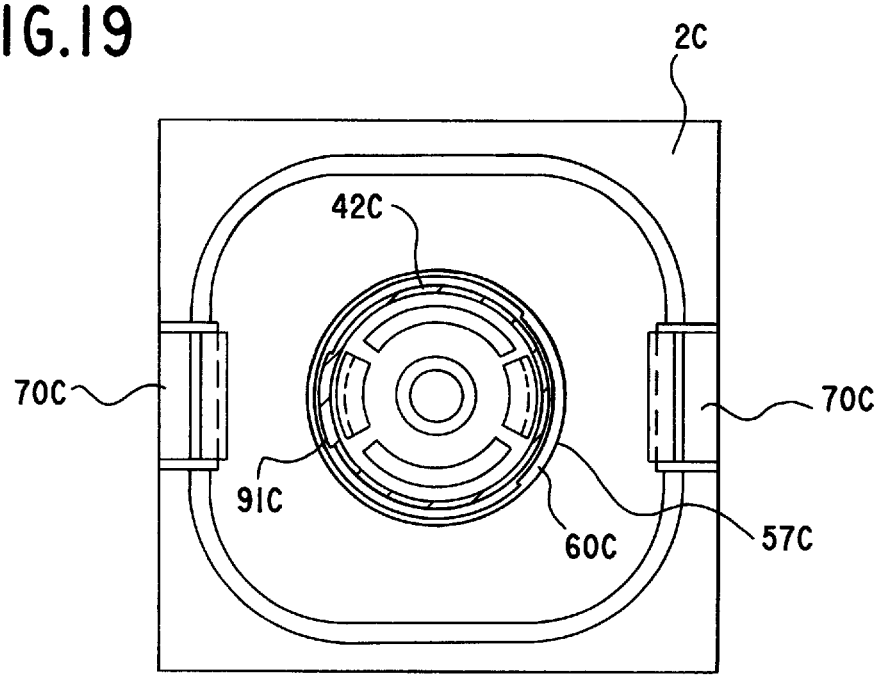
FIG. 19 is a bottom view of the timer housing.
Figure 20:
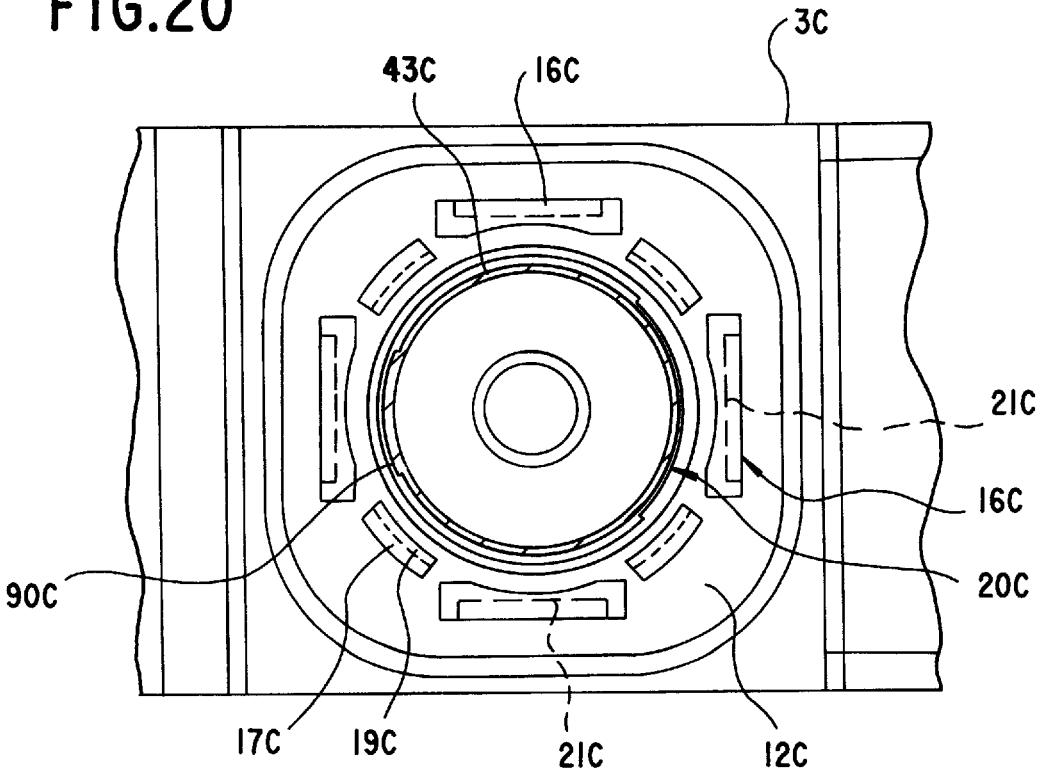
FIG. 20 is a top view of a concave of the switch housing.

The coupling member 40C has a first rotation-restricting portion 90C formed on an outer surface of the second ring-like wall 43C and exposed in the third guide groove 46C, and a second rotation-restricting portion 91C formed on an outer surface of the first ring-like wall 42C and exposed in the second guide groove 44C. Since the first restricting portion 90C collides with a first projection 20C formed on an inner surface of the outer ring-like wall 15C during a rotation of the coupling member 40C, as shown in FIG. 20, it is possible to restrict the rotation of the coupling member against the switch housing 3C within one turn. Similarly, since the second restricting portion 91C collides with a second projection 60C formed on an inner surface of the sixth ring-like wall 57C during a rotation of the timer housing 2C, as shown in FIG. 19, it is possible to restrict the rotation of the timer housing against the coupling member 40C within one turn.

Lead wires 8C for electrical connection between the electric timer and the switch unit extend through the through holes (13C, 54C) of the switch housing 3C and the timer housing 2C. Therefore, when the timer housing 2C is held at the extended position, it is possible to prevent an exposure of the lead wires 8C, and an invasion of dust inside the switch housing 3C.

Figure 21:
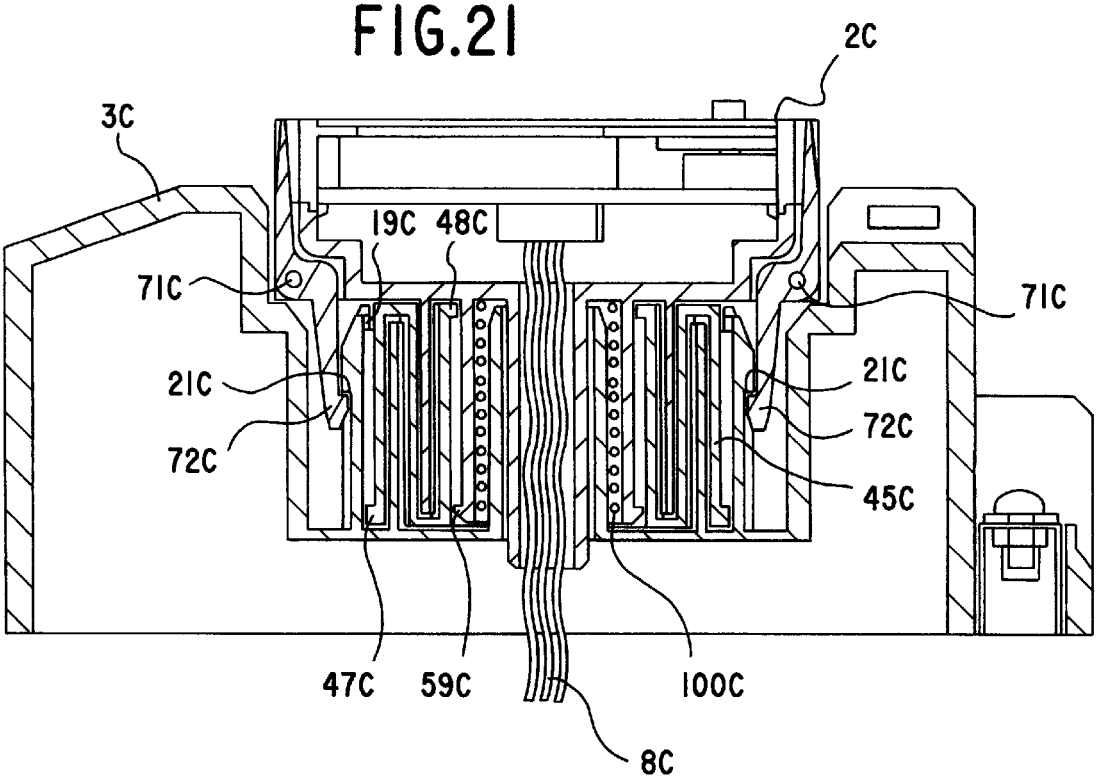
FIG. 21 is a cross-sectional view illustrating a lock state of the timer housing with the switch housing.
Figure 22:
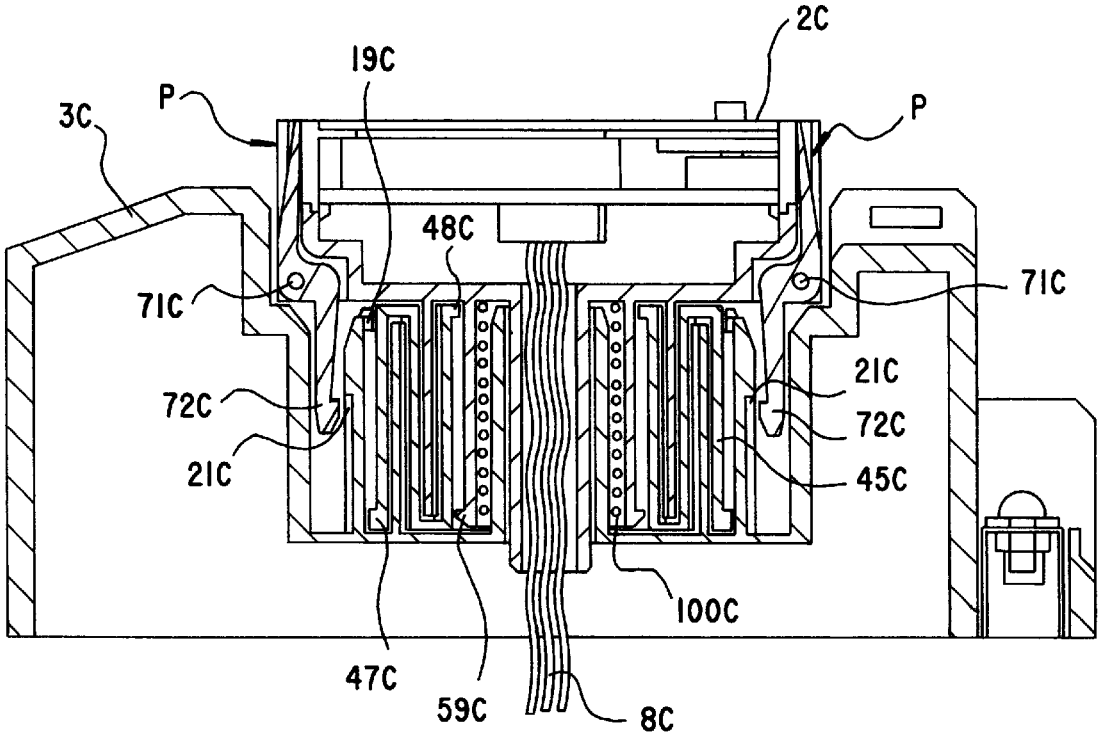
FIG. 22 is a cross-sectional view illustrating a release state of the timer housing from the switch housing.
Figures 23A, 23B, 23C, 23D, 23E:
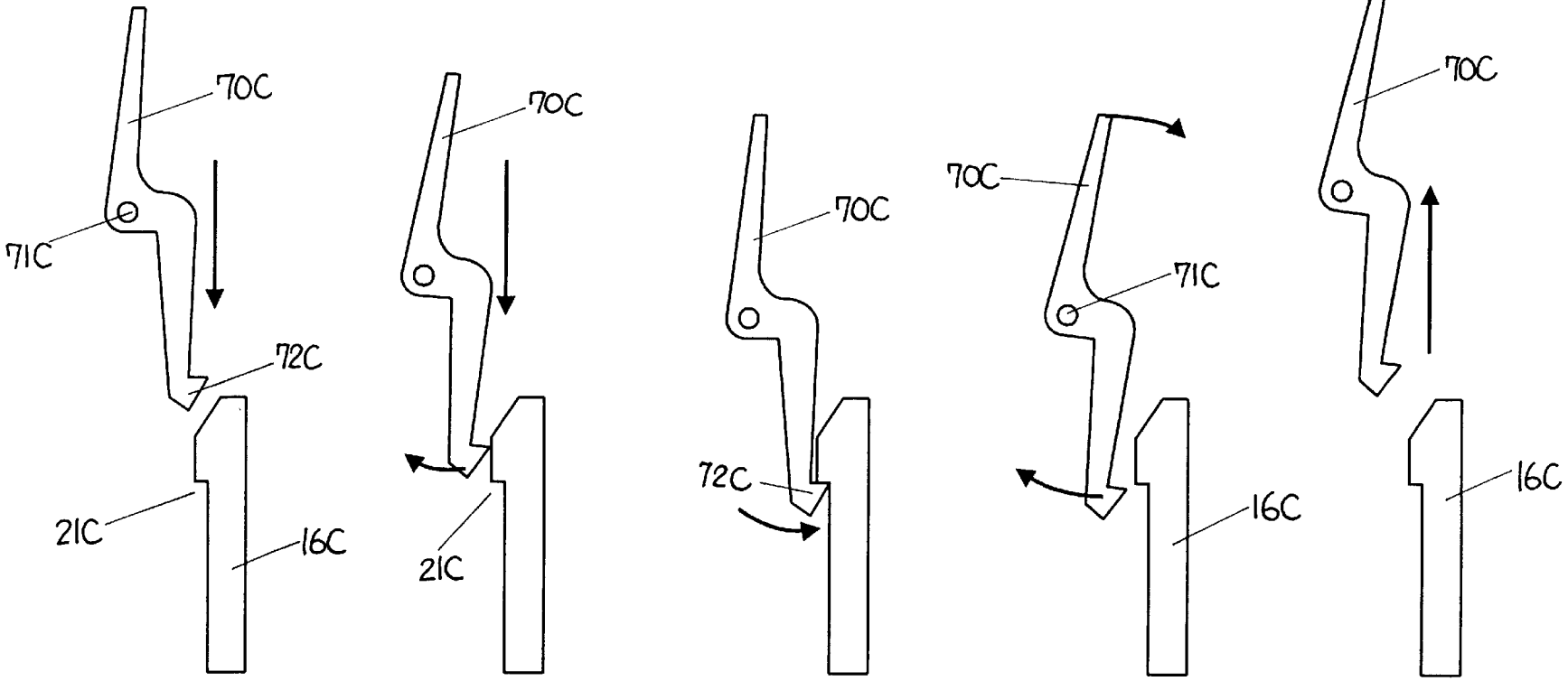

In the time switch 1C of the second embodiment, the timer housing 2C can be locked in the concave 12C of the switch housing 3C at the normal position in accordance with the following manner. Each of the four lock members 16C of the switch housing 3C has a hook catching groove 21C formed in an outer surface of the lock member. The hooks 72C of the release levers 70C can selectively engage to the hook catching grooves 21C of the lock members 16C disposed in a face-to-face relation through the outer ring-like wall 15C. Therefore, it is possible to lock the timer housing 2C in the concave 12C per 90° turn about the center axis of the inner ring-like wall 14C. When moving the timer housing 2C from the extended position to the normal position, each of the hooks 72C firstly collides with an inclined top surface of the lock member 16C, as show in FIG. 23A. As the timer housing 2C is further inserted into the concave 12C, the hook 72C slides along the outer surface of the lock member 16C against the spring bias of the spring member 73C, as shown in FIG. 23B. Then, when the hook 72C reaches to the hook catching groove 21C, the hook is inserted into the hook catching groove by a restoration force of the spring member 73C, as shown in FIG. 23C, so that the locking operation of the timer housing 2C is finished, as shown in FIG. 21. To release the engagement between the hook 72C and the hook catching groove 21C, an user must pinch both top ends of the release levers 70C against the spring bias of the spring member 73C with the use of two fingers, as shown by the arrows P in FIG. 22, so that the hook can be removed from the hook-receiving groove, as shown in FIG. 23D. In this time switch 1C, a spring 100C for exerting a spring bias to the timer housing 2C toward the extended position is disposed such that one end of the spring is inserted into a space between the fourth and fifth ring-like walls (55C, 56C) of the timer housing 2C, and the other end of the spring is inserted into a space between the inner and outer ring-like walls (14C, 15C) of the switch housing 3C. Therefore, it is possible to pull out the timer housing 2C from the normal position to the extended position with a reduced force after the engagement of the hooks 72C is released, as shown in FIG. 23E. Thus, when the release levers 70C are availably exposed on the opposite sides of the timer housing 2C, the user can complete the releasing operation of the timer housing from the normal position with one hand. As a result, this time switch 1C is easy to handle even when the plural number of time switches are densely installed on a switchboard.

Figure 24:
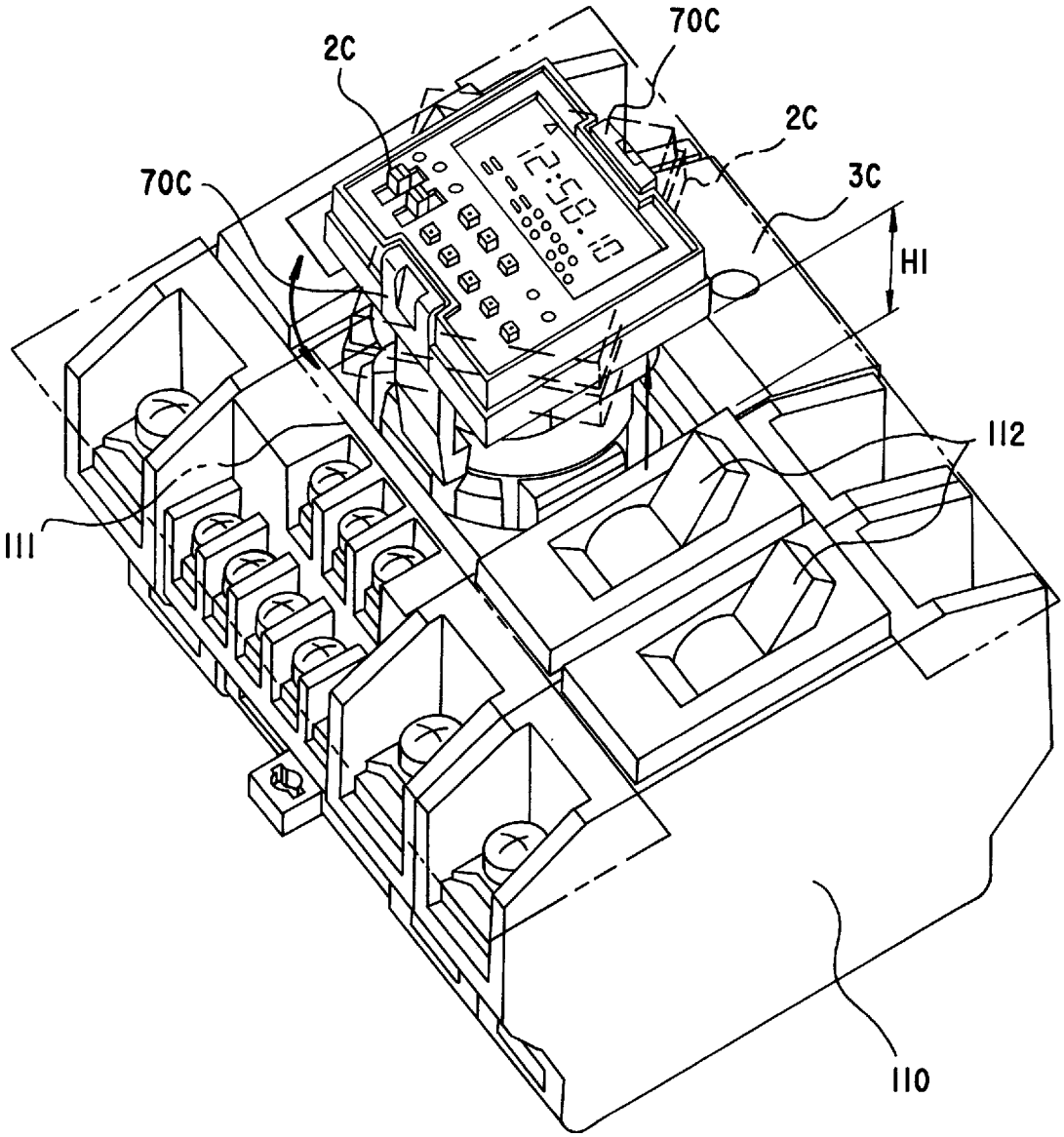
FIG. 24 is a perspective view of the time switch of the second embodiment installed in a breaker case.
Figure 25:
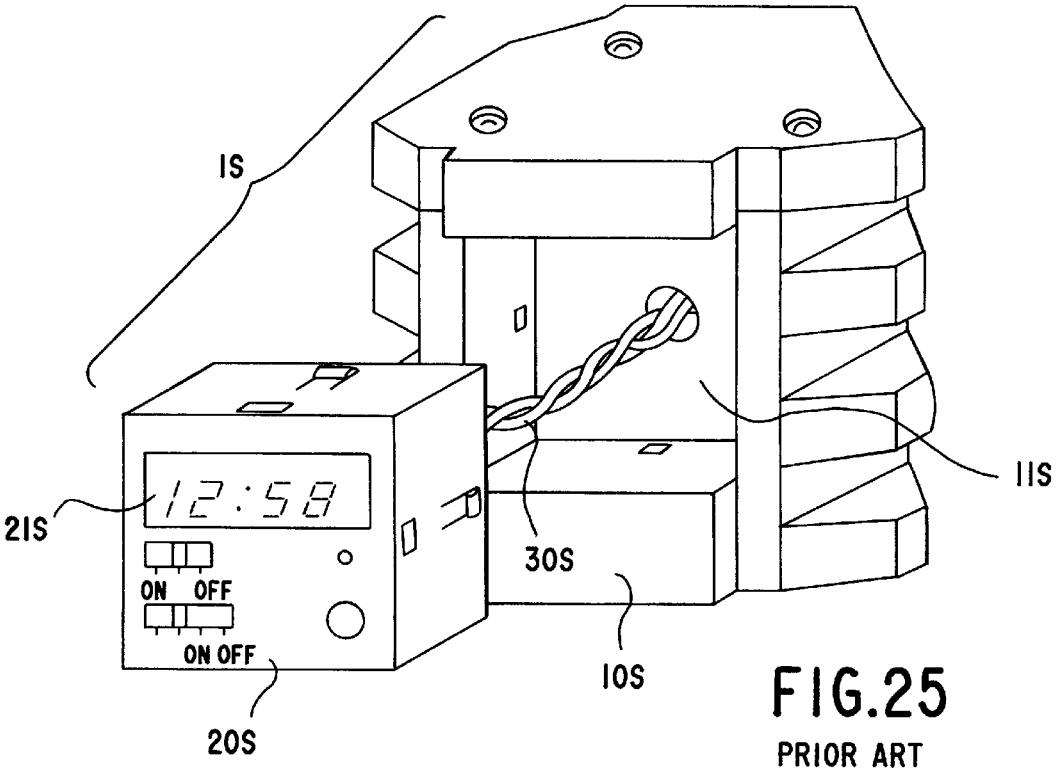
FIG.25 PRIOR ART
FIG. 25 is a perspective view of a time switch of the prior art.
Figure 26:
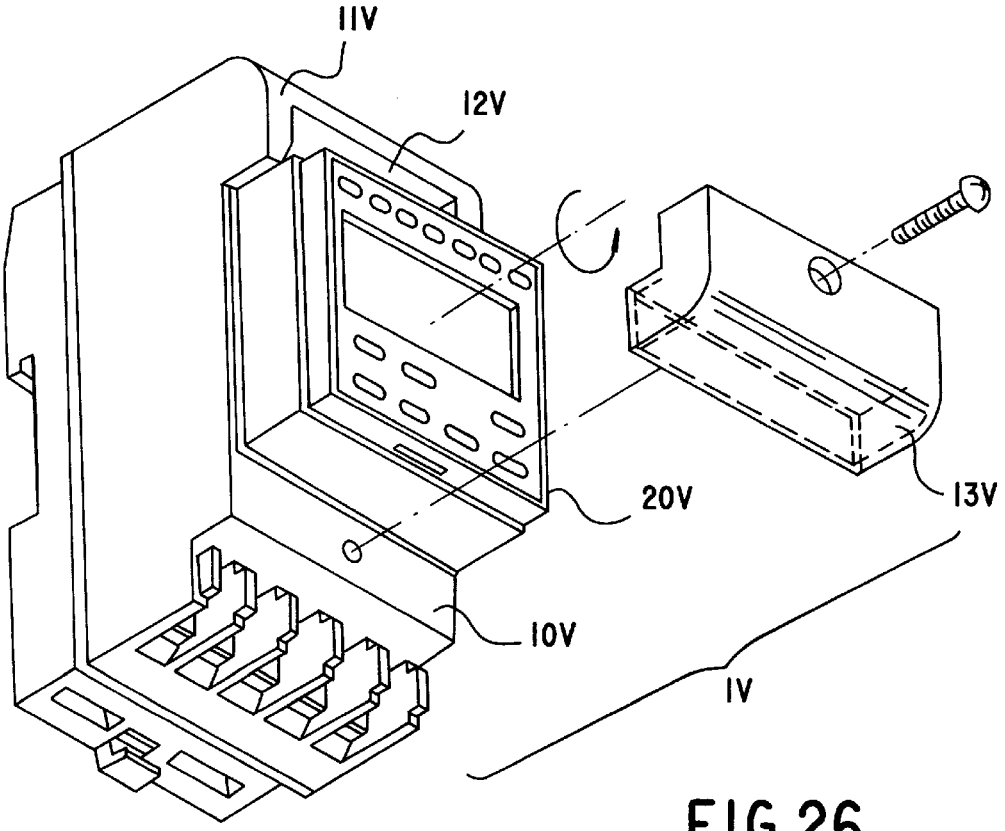
FIG.26 PRIOR ART
FIG. 26 is a perspective view of another time switch of the prior art.

As an example, the time switch 1C of the second embodiment may be installed in a breaker case 110 having a terminal cover 111 and breaker handles 112, as shown in FIG. 24. In this case, it is possible to rotate the timer housing 2C against the switch housing 3C at the extended position without being interfered with the adjacent breaker handle 112 and without removing the terminal cover 111 from the breaker case 110.

What is claimed is:

1. A time switch for starting and stopping an electric appliance at set times, said time switch comprising:

an electric timer;

a display housing having input means for entering set times into said timer and a display for said set times; and a switch housing formed in its top surface with a concave within which said display housing fits such that said input means and said display are available, said switch housing having an input terminal for electrical connection with an electric power source, an output terminal for electrical connection with said electric appliance, and switch means for connecting and disconnecting said electric appliance to and from said electric power source in accordance with an output from said timer;

wherein said time switch includes a coupling member for connection of said display housing to said switch housing, said coupling member comprising a cylinder through which lead wires extend for electrical connection between said timer and said switch means, said coupling member being movably supported to said switch housing along a center axis of said cylinder so that said display housing can move between a normal position where said display housing fits within said concave and an extended position at which said display housing projects out of said concave, and said coupling member being rotatably supported to said switch housing such that said display housing can rotate about said center axis of said cylinder at said extended position without being interfered with said switch housing.

2. A time switch as set forth in claim 1, wherein said coupling member comprises a first coupling member and a second coupling member, said first coupling member having a first cylinder and slidably supported to said switch housing along a center axis of said first cylinder, said second coupling member having a tube-like shape and slidably supported to said first coupling member along said center axis, and said second coupling member depending from said display housing.

3. A time switch as set forth in claim 2, wherein said switch housing has a first cylindrical guide wall projecting into said concave, said display housing has a second cylindrical guide wall having a larger diameter than said second coupling member and depending from said display housing such that said second cylindrical guide wall and said second coupling member are disposed in a concentric manner, and said first coupling member includes a first circular groove into which said first cylindrical guide wall is slidably inserted for guiding said first coupling member to move along said center axis of said first cylinder, and a second circular groove into which said second cylindrical guide wall is slidably inserted for guiding said second coupling member to move along said center axis of said first cylinder.

4. A timer switch as set forth in claim 3 comprising:

means for engaging said display housing to said switch housing to lock said display housing at said normal position; and means for releasing the engagement between said display housing and switch housing to move said display housing toward said extended position.

5. A timer switch as set forth in claim 4 comprising spring means for exerting a spring bias to said display housing toward said extended position when the engagement between said display housing and said switch housing is released.

6. A timer switch as set forth in claim 1, wherein a cross section of said display housing on a plane perpendicular to said center axis of said cylinder is a substantial square, and said concave has a square top opening slightly larger than the cross section of said display housing.

7. A timer switch as set forth in claim 6 comprising click-stop means for providing a click-stop per 90° turn of said display housing at said extended position.

8. A timer switch as set forth in claim 1 comprising stopper means for restricting the rotation of said display housing against said switch housing within one turn.

9. A timer switch as set forth in claim 1 comprising:

means for engaging said display housing to said switch housing to lock said display housing at said normal position; and means for releasing the engagement between said display housing and switch housing to move said display housing toward said extended position.

10. A timer switch as set forth in claim 9 comprising spring means for exerting a spring bias to said display housing toward said extended position when the engagement between said display housing and said switch housing is released.

* * * * *

UNITED STATES PATENT AND TRADEMARK OFFICE

CERTIFICATE OF CORRECTION

PATENT NO. : 5,771,207
DATED : June 23, 1998
INVENTOR(S) : Muroi et al.

It is certified that error appears in the above-identified patent and that said Letters Patent is hereby corrected as shown below:

On the title page in the abstract;

Line 1, change "switch for" to --switch, for--
Line 2, change "times comprises" to --times, includes--
Line 8, change "for connection of the" to --for connecting the--
Line 9 and 10, change "member comprises a" to be --member includes a--
Line 10, change "extends" to --extend--
Lines 19 and 20, delete "presents an advantage that it is easy to check the set times on the display irrespective" and insert therfor --of the invention has the benefit or advantage of being able to easily check the set times on the display regardless--

Column 1,
Line 8, delete "In the past, an" and insert therfor --An--
Line 8, change "of" to --for--
Line 10, change "The time" to -- The known time--
Line 63, change "plural number" to --plurality--
Line 66, insert --by-- before "an"
Line 66, change "For avoiding" to --In order to avoid--

Column 2,
Lines 1 and 2, change "although, this prevents to efficiently install" to --which, however, prevents the efficient installation of--
Line 9, change "above" to --above-discussed--
Line 33, change "with the switch" to --with by the switch--
Lines 36 and 37, change "when the plural number of time" to --when the plurality of time--
Line 40, change "with an adjacent" to --with by an adjacent--
Line 53, change "small size" to --decrease the size--
Line 59, change "with the" to --with by the--

Column 3,
Line 6, change "This can" to --Such structural arrangements can--
Line 17, delete "with"
Line 19, change "switch a first" to --switch of first--

UNITED STATES PATENT AND TRADEMARK OFFICE

CERTIFICATE OF CORRECTION

PATENT NO. : 5,771,207
DATED : June 23, 1998
INVENTOR(S) : Muroi et al.

It is certified that error appears in the above-identified patent and that said Letters Patent is hereby corrected as shown below:

Column 4,
Line 11, change "appliance such as lights at" to be --appliance (such as, lights) at--
Line 21, "outside by the" to --outside with the--
Line 25, change "material such as a synthetic resin" to --material (such as, a synthetic resin)--
Line 30, change "2, although, it is possible to" to --2. It is possible, however to--
Line 39, change "interfered the" to --interfered with by the--
Line 57, change "contact with the" to --contact the--

Column 6,
Line 12, "firstly" to --initially--
Line 18, change "being" to --is--
Line 18, change "pointed" to --illustrated--
Line 33, change "by" to --with--
Line 50, change "can not" to --cannot--
Line 52, change "the first" to --the above described first--

Column 7,
Line 11, change "interfered the" to --intefered with by the--
Line 12, change "pointed out" to --illustrated--
Line 26, change "relation" to --relationship--
Line 37, change "an" to --a--
Line 39, change "relation" to --relationship--
Line 42, change "relation" to --relationship--
Line 47, change "46C," to --46C;--

UNITED STATES PATENT AND TRADEMARK OFFICE

CERTIFICATE OF CORRECTION

PATENT NO. : 5,771,207
DATED : June 23, 1998
INVENTOR(S) : Muroi et al.

It is certified that error appears in the above-identified patent and that said Letters Patent is hereby corrected as shown below:

Column 8,
Line 12, change "relation" to --relationship--
Line 55, change "and an" to --and prevent an--

Column 9,
Line 3, change "firstly" to --initially--
Line 9, change "reaches to the" to --reaches the--
Line 13, change "To release" to --In order to--
Line 14, change "an" to --a--
Line 30, change "are availably exposed" to --are exposed--
Line 31, change "releasing" to --release--
Line 34, change "plural number" to --plurality--
Line 41, change "with the" to --with by the--

At the end of line 43 add--While the invention has been particular shown and described in reference to preferred embodiments thereof, it will be understood by those skilled in the art that changes in form and details may be made therein without departing from the spirit and scope of invention--

Line 52, change "its" to --a--
Line 52, change "surface with" to --surface thereof with--
Line 60, change "timer;" to --timer,--
Line 62, change "connection of" to --connecting--
Line 63, change "comprising" to --including--

UNITED STATES PATENT AND TRADEMARK OFFICE

CERTIFICATE OF CORRECTION

PATENT NO. : 5,771,207
DATED : June 23, 1998
INVENTOR(S) : Muroi et al.

It is certified that error appears in the above-identified patent and that said Letters Patent is hereby corrected as shown below:

Column 10,
Line 8, change "with said" to --with by said--
Line 19, change "concave, said" to --concave, wherein said--
Line 23, after "and" insert therefor --wherein--
Line 30, change "claim 3 comprising" to --claim 3, further comprising:--
Line 38, change "claim 4 comprising" to --claim 4, further comprising--
Line 51, change "claim 1 comprising" to --claim 1, further comprising--
Line 54, change "claim 1 comprising" to --claim 1, further comprising--
Line 61, change "claim 9 comprising" to --claim 9, further comprising--

Signed and Sealed this

Seventh Day of August, 2001

*Attest:*

Nicholas P. Godici

NICHOLAS P. GODICI
*Acting Director of the United States Patent and Trademark Office*

*Attesting Officer*